US010018079B2

(12) United States Patent
Zhou

(10) Patent No.: US 10,018,079 B2
(45) Date of Patent: Jul. 10, 2018

(54) THERMODYNAMIC SYSTEM IN A VEHICLE

(71) Applicant: Ford Global Technologies, LLC, Dearborn, MI (US)

(72) Inventor: Shiguang Zhou, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 601 days.

(21) Appl. No.: 14/603,752

(22) Filed: Jan. 23, 2015

(65) Prior Publication Data

US 2016/0214465 A1 Jul. 28, 2016

(51) Int. Cl.
*F01K 23/06* (2006.01)
*F01K 15/02* (2006.01)

(52) U.S. Cl.
CPC ..... *F01K 23/065* (2013.01); *F01K 15/02* (2013.01)

(58) Field of Classification Search
CPC ..... F01K 23/065; F01K 15/02
USPC ..... 60/320
See application file for complete search history.

(56) References Cited

U.S. PATENT DOCUMENTS 3,429,122 A * 2/1969 Pravda ..... F01D 5/181 165/104.26
3,604,503 A * 9/1971 Feldman, Jr. ..... F28D 15/0241 165/104.26
3,913,665 A * 10/1975 Franklin ..... F28D 15/0241 122/366
3,986,665 A * 10/1976 Kofink ..... B60H 1/20 123/41.04
4,140,173 A * 2/1979 Wulf ..... B60H 1/20 165/10
4,146,176 A * 3/1979 Beauvais ..... B60H 1/00007 165/274
4,183,399 A * 1/1980 Seehausen ..... F28D 15/04 165/103
4,296,796 A * 10/1981 Wulf ..... B60H 1/00507 165/104.26
4,976,308 A * 12/1990 Faghri ..... F28D 15/02 165/10
5,000,003 A 3/1991 Wicks
5,220,954 A * 6/1993 Longardner ..... F28D 20/021 165/10
7,178,332 B2 * 2/2007 Sasaki ..... F01N 3/2013 136/205

(Continued)

FOREIGN PATENT DOCUMENTS

CN 102536510 A 7/2012
FR 2961587 A1 12/2011

*Primary Examiner* — Jason Newton
(74) *Attorney, Agent, or Firm* — Brooks Kushman P.C.; Julia Voutyras

(57) ABSTRACT

A vehicle includes an engine having an exhaust system, and a heat pipe containing a phase change material. The heat pipe has a condenser region and an evaporative region in thermal contact with the exhaust system, and defines a vapor space and a liquid space separated by a wicking layer. The vehicle has an expander, a condenser, a pump, a first heater, and a second heater in sequential fluid communication in a thermodynamic cycle containing a working fluid. The first heater is in thermal contact with exhaust gases in the exhaust system. The second heater is in thermal contact with the condenser region of the heat pipe.

18 Claims, 3 Drawing Sheets

(56) References Cited

U.S. PATENT DOCUMENTS

| | | | | |
|---|---|---|---|---|
| 7,921,640 | B2 * | 4/2011 | Major | F01N 5/025 165/51 |
| 8,327,634 | B2 * | 12/2012 | Orihashi | F01N 3/055 165/51 |
| 8,408,166 | B1 | 4/2013 | Zhou et al. | |
| 8,806,858 | B2 | 8/2014 | Zhou et al. | |
| 2008/0141664 | A1 * | 6/2008 | Bidner | F01N 5/02 60/320 |
| 2010/0011753 | A1 * | 1/2010 | Bidner | H01L 35/30 60/320 |
| 2011/0100009 | A1 * | 5/2011 | Lehar | F01K 23/10 60/651 |
| 2013/0134720 | A1 * | 5/2013 | Fukasaku | F01C 1/0215 290/40 R |
| 2013/0186076 | A1 * | 7/2013 | Zhou | F01N 3/043 60/321 |
| 2014/0026869 | A1 | 1/2014 | Zhou et al. | |
| 2014/0202178 | A1 * | 7/2014 | Trumbower | B60L 11/1874 62/62 |
| 2015/0013338 | A1 * | 1/2015 | Smague | F01K 13/02 60/645 |
| 2015/0377180 | A1 * | 12/2015 | Jacquot | F02G 5/02 60/320 |
| 2016/0214462 | A1 * | 7/2016 | Zhou | F01K 15/02 |

* cited by examiner

THERMODYNAMIC SYSTEM IN A VEHICLE

TECHNICAL FIELD

Various embodiments related to controlling a thermodynamic system, such as a Rankine cycle, in a vehicle for waste heat energy recovery.

BACKGROUND

Vehicles, including hybrid vehicles, have internal combustion engines that produce exhaust gases at a high temperature. A thermodynamic cycle such as a Rankine cycle may be used to recover waste heat from the engine exhaust during vehicle operation. Often, the engine exhaust may directly heat the working fluid in the thermodynamic cycle in a heat exchanger.

SUMMARY

In an embodiment, a vehicle is provided with an engine having an exhaust system, and a heat pipe containing a phase change material. The heat pipe has a condenser region and an evaporative region in thermal contact with the exhaust system. An expander, a first heat exchanger, a pump, and a second heat exchanger are provided in sequential fluid communication in a thermodynamic cycle containing a working fluid. The second heat exchanger is in thermal contact with the condenser region of the heat pipe.

In another embodiment, a vehicle is provided with an engine having an exhaust system, and a heat pipe containing a phase change material. The heat pipe has a condenser region and an evaporative region in thermal contact with the exhaust system. The heat pipe defines a vapor space and a liquid space separated by a wicking layer. An expander, a condenser, a pump, a first heater, and a second heater are provided in sequential fluid communication in a thermodynamic cycle containing a working fluid. The first heater is in thermal contact with exhaust gases in the exhaust system. The second heater is in thermal contact with the condenser region of the heat pipe.

In yet another embodiment, a method is provided and controls a pump, a heater, an expander, and a condenser in a closed loop in a vehicle for energy recovery using a mixed phase working fluid. The working fluid is heated in the heater by heat transfer from a condenser region of a heat pipe containing a phase change material. The phase change material is heated in an evaporator region of the heat pipe by heat transfer from engine exhaust gases.

Various examples of the present disclosure have associated, non-limiting advantages. For example, a thermodynamic cycle in a vehicle may be used to recover waste heat and energy and increase vehicle efficiency. The thermodynamic cycle may be a Rankine cycle. A heat pipe is provided to receiver waste heat from the engine exhaust gases and heat the working fluid in the thermodynamic cycle. The heat pipe provides a passive device for heat transfer between the exhaust gases and the working fluid. The heat pipe is a closed, sealed system that contains a phase change material that operates between a liquid phase and a vapor phase. The high efficiency and thermal conductivity of the heat pipe provides a reliable and effective way of heating the working fluid in the cycle and recovering waste heat from the exhaust gases. The heat pipe may also be selected for selective cooling of the exhaust gases based on emissions system requirements. For example, when the heat pipe is provided in an exhaust system upstream of an emissions system, it may be desirable to not operate the heat pipe when the exhaust gases are below a predetermined temperature. When the exhaust gases are below a predetermined temperature, any further cooling of the exhaust gases, for example, with a conventional air or water cooled heat exchanger without a bypass system, may delay a catalytic converter light off at a cold start condition, and running the engine at a fuel rich condition may reduce fuel economy for the vehicle. A heat pipe containing a working fluid selected based on the predetermined temperature of the exhaust gases may only operate above this predetermined temperature, as below the temperature, working fluid will not undergo a phase change, and therefore the heat will not operate. In one example, the working fluid in the heat pipe comprises sodium at a pressure to provide a phase change above 700 degrees Celsius, which may not affect light off of the catalytic converter. As the heat pipe only operates above the predetermined exhaust gas temperature, there is no need for a bypass system, and the heat pipe selectively provides heat to the Rankine cycle without use of an additional control system.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention. Description of constituents in chemical terms refers to the constituents at the time of addition to any combination specified in the description, and does not necessarily preclude chemical interactions among constituents of the mixture once mixed. A fluid as described in the present disclosure may refer a substance in various states or phases including to vapor phase, liquid phase, mixed vapor/liquid phase, superheated gases, sub-cooled liquids, and the like.

A thermodynamic cycle such as a Rankine cycle may be used to convert thermal energy into mechanical or electrical power. Efforts have been made to collect thermal energy more effectively from engine exhaust gases as they reject waste heat in the vehicle. The present disclosure provides for a Rankine cycle with a heat pipe provided between the exhaust manifold and the evaporator of the cycle. The heat pipe contains another working fluid with phase separation during operation. The exhaust gases heat and evaporate the working fluid in the heat pipe. The working fluid in the heat pipe then heats the working fluid in the cycle in the evaporator (or heat pipe condensing portion) such that the working fluid in the heat pipe condenses to a liquid phase as the working fluid in the cycle is evaporated.

Figure 1:
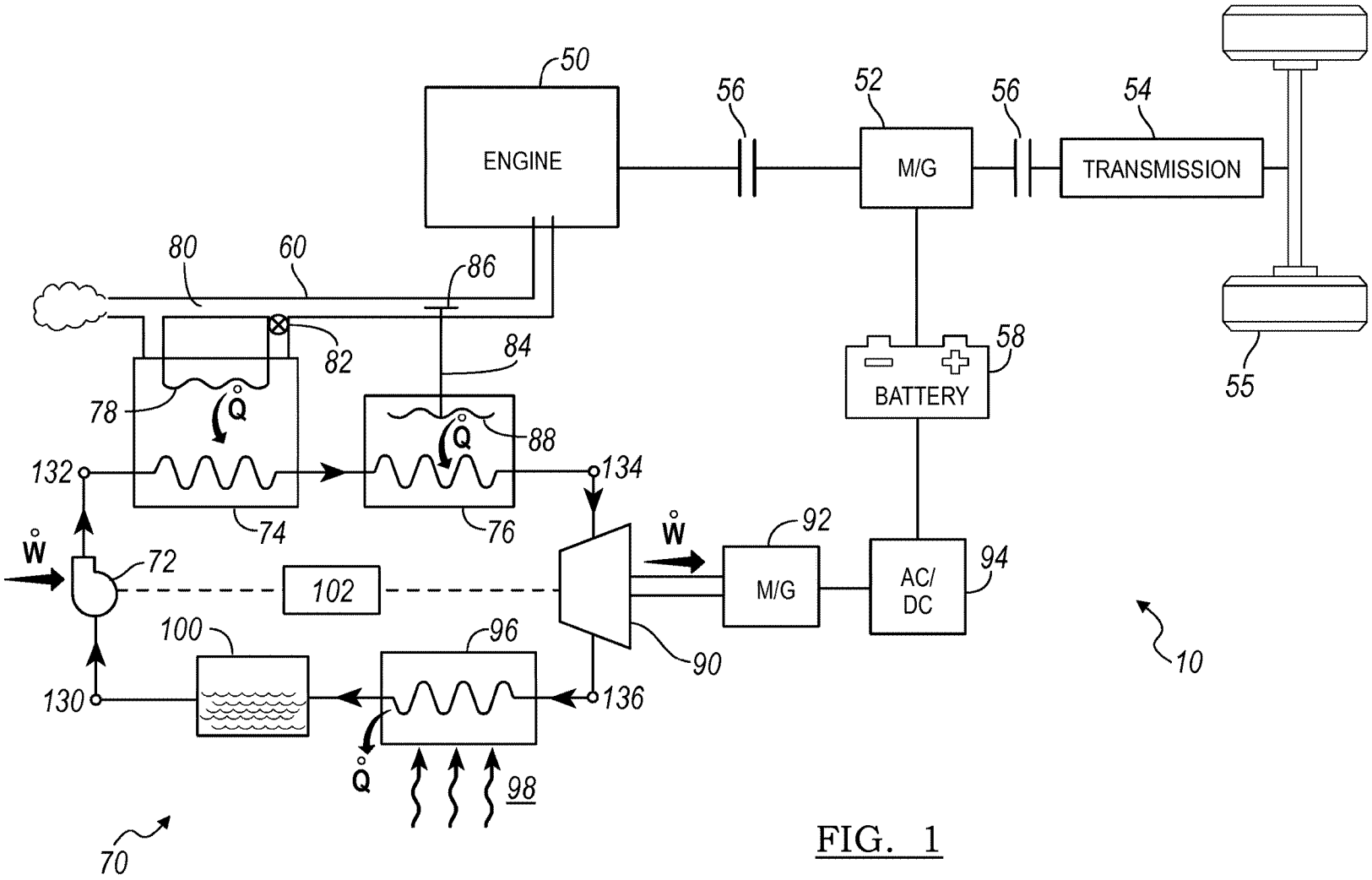
FIG. 1 illustrates a schematic of systems of a vehicle according to an embodiment.

FIG. 1 illustrates a simplified schematic of various systems within a vehicle 10 according to an example. Fluids in various vehicle systems may be cooled via heat transfer to a working fluid within heat exchangers of a Rankine cycle, and the working fluid is in turn cooled in a condenser of the Rankine cycle using ambient air. The Rankine cycle allows for energy recovery by converting waste heat in the vehicle to electrical power or mechanical power that would otherwise be transferred to ambient air.

The vehicle may be a hybrid vehicle with multiple sources of torque available to the vehicle wheels. In other examples, the vehicle is a conventional vehicle with only an engine. In the example shown, the vehicle has an internal combustion engine 50 and an electric machine 52. The electric machine 52 may be a motor or a motor/generator. The engine 50 and the electric machine 52 are connected via a transmission 54 to one or more vehicle wheels 55. The transmission 54 may be a gearbox, a planetary gear system, or other transmission. Clutches 56 may be provided between the engine 50, the electric machine 52, and the transmission 54. The powertrain may be configured in various manners including as a parallel, a series, or a series-parallel hybrid vehicle.

The electric machine 52 receives electrical power to provide torque to the wheels 55 from a traction battery 58. The electric machine 52 may also be operated as a generator to provide electrical power to charge the battery 58, for example, during a braking operation.

The engine 50 may be an internal combustion engine such as a compression ignition engine or spark ignition engine. The engine 50 has an exhaust system 60 through which exhaust gases are vented from cylinders in the engine 50 to atmosphere. The exhaust system 60 has an exhaust manifold connected to the exhaust ports of the engine cylinders. The exhaust system 60 may include a muffler for noise control. The exhaust system 60 may include one or more emissions control systems, such as a three way catalyst, catalytic converter, particulate filter, and the like. In some examples, the exhaust system 60 may also include an exhaust gas recirculation (EGR) system and/or a compressions device such as a turbocharger.

The engine 50 also has a coolant system. The coolant system contains an engine coolant fluid, which may include water, glycol, and/or another fluid, to remove heat from the engine 50 during operation. The engine 50 may be provided with an internal or external cooling jacket with passages to remove heat from various regions of the engine 50 using the recirculating engine coolant fluid. The coolant system may include a pump, a radiator, and a reservoir (not shown).

The vehicle has a thermodynamic cycle 70. In one example, the cycle 70 is a Rankine cycle. In another example, the cycle 70 is a modified Rankine cycle, or another thermodynamic cycle that includes a working fluid transitioning through more than one phase during cycle operation. The Rankine cycle 70 contains a working fluid. In one example, the working fluid undergoes phase change and is a mixed phase fluid within the system. The working fluid may be R-134a, R-245, or another organic or inorganic chemical refrigerant based on the desired operating parameters of the cycle.

The cycle 70 has a pump 72, compressor, or other device configured to increase the pressure of the working fluid. The pump 72 may be a centrifugal pump, a positive displacement pump, etc. The working fluid flows from the pump 72 to one or more heat exchangers. The heat exchangers may be preheaters, evaporators, superheaters, and the like configured to transfer heat to the working fluid.

The example shown has a first heat exchanger 74, which is configured as an evaporator. A second heat exchanger 76 is provided, and may be configured as a superheater. In other examples, greater or fewer heat exchangers may be provided downstream of the pump 72. For example, the cycle 70 may be provided only with heat exchanger 76, or may be provided with three or more heat exchangers to heat the working fluid. Additionally, the heat exchangers downstream of the pump 72 may be arranged or positioned in various manners relative to one another, for example, in parallel, in series as shown, or in a combination of series and parallel flows.

The heat exchangers 74, 76 are configured to transfer heat from an outside heat source to heat the working fluid within the cycle 70. In the example shown, the heat exchangers 74, 76 are configured to transfer heat from engine exhaust gases to the working fluid in the cycle 70. The temperature of the engine exhaust is reduced, and the temperature of the working fluid of the cycle 70 is likewise increased via the heat exchangers 74, 76. The engine exhaust gases may heat the working fluid in the cycle 70 such that the working fluid undergoes a phase change from a liquid phase to a vapor phase.

For heat exchanger 74, the engine exhaust gases in exhaust system 60 may flow through the heat exchanger 74 to directly transfer heat to the working fluid in the cycle 70. The engine exhaust system 60 may have a first flow path 78 through or in contact with the heat exchanger 74. The engine exhaust system 60 may also have a second, or bypass, flow path 80 to divert exhaust gas flow around the heat exchanger 74. A valve 82 may be provided to control the amount of exhaust gas flowing through the heat exchanger 74, which in turn provides a control over the amount of heat transferred to the working fluid, and the temperature and state of the working fluid upstream of the expander 90. The heat exchanger 74 may be configured in various manners, for example, the heat exchanger 74 may be a single pass or multipass heat exchanger, and may provide for co-flow, cross-flow, or counterflow.

A second heat exchanger 76 is also provided in the cycle 70. The heat exchanger 76 is formed by chamber and is configured for heat transfer between a heat pipe 84 and the working fluid in the cycle 70. Generally, the heat pipe 84 is a closed heat transfer device containing a phase change material. The phase change material may be a different chemical solution or mixture from the working fluid of the cycle 70, or in other example, may be the same chemical solution. The heat pipe 84 may have a sealed tube or structure that uses phase transition to transfer heat between two interfaces. The heat pipe 84 has a hot interface, or evaporative region 86 in thermal contact or communication with the exhaust system 60. The phase change material within the heat pipe 84 absorbs heat and turns into a vapor at the evaporative region 86. The vapor then travels through the heat pipe 84 to a cold interface or condenser region 88 and condenses into a liquid and releases latent heat. The liquid then returns to the evaporative region 86 and the cycle repeats.

The heat pipe 84 may be provided as a single heat pipe or multiple heat pipes, and each heat pipe may have a single tube or multiple lobes. The heat pipe 84 may have various geometries and configurations based on the packaging constraints with the vehicle and heat transfer requirements for the cycle 70. The heat pipe 84 is described in greater detail below with reference to FIGS. 4 and 5.

At least one of the heat exchangers 74, 76 is configured to transfer sufficient heat to the working fluid in the cycle 70 to evaporate the working fluid, as discussed further below. The evaporator receives the working fluid in a liquid phase or liquid vapor mixed phase solution, and heats the working fluid to a vapor phase or superheated vapor phase. The disclosure generally describes using heat exchanger 74 as an evaporator using the engine exhaust 60; however, heat exchanger 76 may also act as the evaporator.

The vehicle 10 is illustrated as having the heat pipe 84 upstream of the heat exchanger 74 in the exhaust system 60, which is based on exhaust gas temperatures. In other example, the vehicle may be configured for another arrangement of exhaust gas flow across the heat pipe 84 and through the heat exchanger 74. Any emissions control devices or other systems or devices in the exhaust system may be positioned in various manners relative to the heat pipe 84 and heat exchanger 74 while remaining within the spirit and scope of the disclosure.

The expander 90 may be a turbine, such as a centrifugal or axial flow turbine, or another similar device. The expander 90 is rotated by the working fluid to produce work as the working fluid expands. The expander 90 may be connected to a motor/generator 92 to rotate the motor/generator to generate electrical power, or to another mechanical linkage to provide additional power to the driveshaft and wheels 55. The expander 90 may be connected to the generator 92 by a shaft or another mechanical linkage. The generator 92 is connected to the battery 58 to provide electrical power to charge the battery 58. An inverter or AC-DC converter 94 may be provided between the generator 92 and the battery 58.

The working fluid in the cycle 70 leaves the expander 90 and flows to a heat exchanger 96, also referred to as a condenser 96 in the cycle 70. The condenser 96 may be positioned in a front region of the vehicle 10. The condenser 96 is configured to be in contact with an ambient air flow 98 such that heat is transferred from the working fluid to the ambient air flow to remove heat from the working fluid and cool and/or condense the working fluid. The condenser 96 may be a single stage or multiple stages, and the flow of the working fluid may be controllable through the various stages as required by the cycle 70 using values or other mechanisms.

In some examples, the cycle 70 includes a fluid accumulator 100 or dryer. The accumulator 100 may be provided as a fluid or liquid reservoir for the working fluid in the cycle 70. The pump 72 draws fluid from the accumulator 100 to complete the cycle 70. As can be seen from FIG. 1, the cycle 70 is a closed loop cycle such that the working fluid does not mix with the phase change material in the heat pipe 84, other fluids in the vehicle, or with ambient air. Likewise, heat pipe 84 is a closed system such that the phase change material in the heat pipe does not mix with the working fluid in the cycle 70, other fluids in the vehicle, or with ambient air.

The cycle 70 may include a controller 102 that is configured to operate the cycle within predetermined parameters as described below. The controller 102 may be incorporated with or be in communication with an engine control unit (ECU), a transmission control unit (TCU), a vehicle system controller (VSC), or the like, and may also be in communication with various vehicle sensors. The control system for the vehicle 10 may include any number of controllers, and may be integrated into a single controller, or have various modules. Some or all of the controllers may be connected by a controller area network (CAN) or other system. The controller 102 and the vehicle control system may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the vehicle or the cycle 70.

Figure 2:
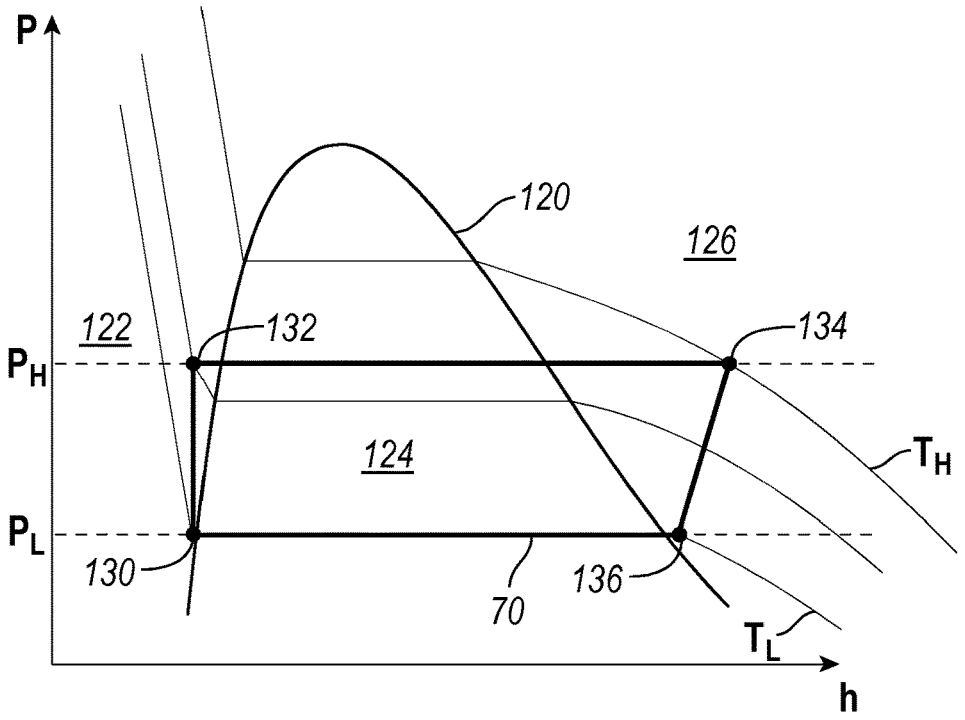
FIG. 2 illustrates a simplified pressure—enthalpy diagram for the Rankine cycle of FIG. 1.

FIG. 2 illustrates a pressure—enthalpy chart for the working fluid of the Rankine or thermodynamic cycle 70 as shown in FIG. 2. The chart has pressure (P) on the vertical axis and enthalpy (h) on the horizontal axis. Enthalpy may have units of energy per unit mass, e.g. kJ/kg.

The dome 120 provides a separation line between the various phases of the working fluid. The working fluid is a liquid or sub-cooled liquid in region 122 to the left of the dome 120. The working fluid is a vapor or superheated vapor in region 126 to the right of the dome 120. The working fluid is a mixed phase, e.g. a mixture of liquid and vapor phase, in region 124 underneath the dome 120. Along the left hand side of the dome 120, where region 122 and 124 meet, the working fluid is a saturated liquid. Along the right hand side of the dome 120, where region 124 and 126 meet, the working fluid is a saturated vapor.

The Rankine cycle 70 of FIG. 1 is illustrated on the chart according to an embodiment. The charted cycle 70 is simplified for the purposes of this disclosure, and any losses in the cycle 70 or system are not illustrated although they may be present in actual applications. Losses may include pumping losses, pipe losses, pressure and friction losses, heat loss through various components, and other irreversibilities in the system. The operation of the cycle 70 as shown in FIG. 2 in simplified to assume constant pressure, and adiabatic, reversible, and/or isentropic process steps as appropriate and as described below; however, one of ordinary skill in the art would recognize that the cycle 70 may vary from these assumptions in a real-world application. The cycle is charted as operating between a high pressure, $P_H$, and a low pressure, $P_L$. Constant temperature lines are shown on the chart as well, e.g. $T_H$ and $T_L$.

The cycle 70 begins at point 130 where the working fluid enters the pump 72. The working fluid is a liquid at 130, and may be sub-cooled to a temperature of 2-3 degrees Celsius or more below the saturation temperature at $P_L$. The working fluid leaves the pump 72 at point 132 at a higher pressure, $P_H$, and in a liquid phase. In the example shown, the pumping process from 130 to 132 is modeled as being isentropic, or adiabatic and reversible.

The working fluid enters one or more heat exchangers at 132, for example, heat exchangers 74, 76. The working fluid is heated within the heat exchangers 74, 76 using waste heat from the engine exhaust. The working fluid leaves the heat exchangers as a vapor or superheated vapor at point 134. The heating process from 132 to 134 is modeled as a constant pressure process. As can be seen from the Figure, the process from 132 to 134 occurs at $P_H$, and the temperature increases to $T_H$ at 134. The working fluid begins in a liquid phase at 132 and leaves the heat exchangers 74, 76 in a superheated vapor phase at 134.

The working fluid enters an expander 90, such as a turbine, at point 134 as a superheated vapor. The working fluid drives or rotates the expander as it expands to produce work. The working fluid exits the expander 90 at point 136 at a pressure, $P_L$. The working fluid may be a superheated vapor at 136, as shown. In other examples, the working fluid may be a saturated vapor or may be mixed phase and in region 124 after exiting the expander 90. In a further example, the working fluid is within a few degrees Celsius of the saturated vapor line on the right hand side of dome 120. In the example shown, the expansion process from 134 to 136 is modeled as isentropic, or adiabatic and reversible. The expander 90 causes a pressure drop and a corresponding temperature drop across the device as the working fluid expands.

The working fluid enters one or more heat exchangers at 136, for example, heat exchanger 96. The working fluid is cooled within the heat exchanger 96 using ambient air received through the frontal region of the vehicle. The working fluid leaves the heat exchanger at point 130, and then flows to the pump 72. An accumulator may also be included in the cycle 70. The heating process from 136 to 130 is modeled as a constant pressure process. As can be seen from the Figure, the process from 136 to 130 occurs at $P_L$. The temperature of the working fluid may decrease within the heat exchanger 96. The working fluid begins as a superheated vapor or vapor-liquid mixed phase at 136 and leaves the heat exchanger 96 as a liquid at 130.

In one example, the cycle 70 is configured to operate with a pressure ratio of $P_H$ to $P_L$ of approximately 3, or in a further example, with a pressure ratio of approximately 2.7. In other examples, the pressure ratio may be higher or lower. The cycle 70 may be adapted to operate in various ambient environments as required by the vehicle and its surrounding environment. In one example, the cycle 70 is configured to operate across a range of possible ambient temperatures. The ambient temperature may provide a limit to the amount of cooling available for the working fluid in the heat exchanger 96. In one example, the cycle 70 may be operated between an ambient or environmental temperature of −25 degrees Celsius and 40 degrees Celsius. In other examples, the cycle 70 may operate at higher and/or lower ambient temperatures.

The power provided by the cycle 70 may be a function of the mass flow rate of the waste heat fluid, the temperature of the waste heat fluid, the temperature of the working fluid at point 134, and the mass flow rate of ambient air. For example, with exhaust gas providing the source of waste heat, the power provided by the cycle 70 is a function of the mass flow rate of exhaust gas through the heat exchanger 74, the temperature of the exhaust gas entering heat exchanger 74, the temperature of the vapor phase change material in the heat pipe 84, the mass flow rate and temperature of the working fluid at point 134, and the mass flow rate of ambient air. In one example, the power out of the cycle 70 was on the order of 0.5-1.5 kW, and in a further example, was approximately 1 kW for a cycle with exhaust temperatures ranging from 500-800 degrees Celsius, and an exhaust gas mass flow rate ranging from 50-125 kg/hr.

The efficiency of the cycle 70 with respect to the vehicle may be determined based on the electric power produced by the generator 92, and rate(s) of heat transfer available from the waste heat sources, e.g. engine exhaust. The rate of heat available is a function of the mass flow rate of the waste heat fluid through the associated cycle heat exchanger and the temperature difference of the waste heat fluid across the heat exchangers. In one example, the cycle efficiency was measured to be above 5% on average using exhaust gas heat only, and in a further example, the cycle efficiency was measured to be above 8% on average for a cycle using exhaust gas waste heat only.

Maintaining the state or phase of the working fluid at specific operation points within the cycle 70 may be critical for system operation and maintaining system efficiency. For example, one or both of the heat exchangers 74, 76 may need to be designed for use with a liquid phase, a mixed phase fluid, and a vapor phase fluid. The working fluid may need to be a liquid phase at point 130 in the cycle to prevent air lock within the pump 72. Additionally, it may be desirable to maintain the working fluid as a vapor between points 134 and 136 based on the expander 90 construction, as a mixed phase may reduce system efficiencies or provide wear on the device 90. Based on the ambient air temperature, and the speed of the vehicle, which controls the ambient air flow rate, the amount and/or rate of cooling that is available to the working fluid within the heat exchanger 96 may also be limited. Furthermore, the amount and/or rate of heat available to heat the working fluid may be limited at vehicle start up when the engine exhaust and/or engine coolant has not reached their operating temperatures.

Figure 3:
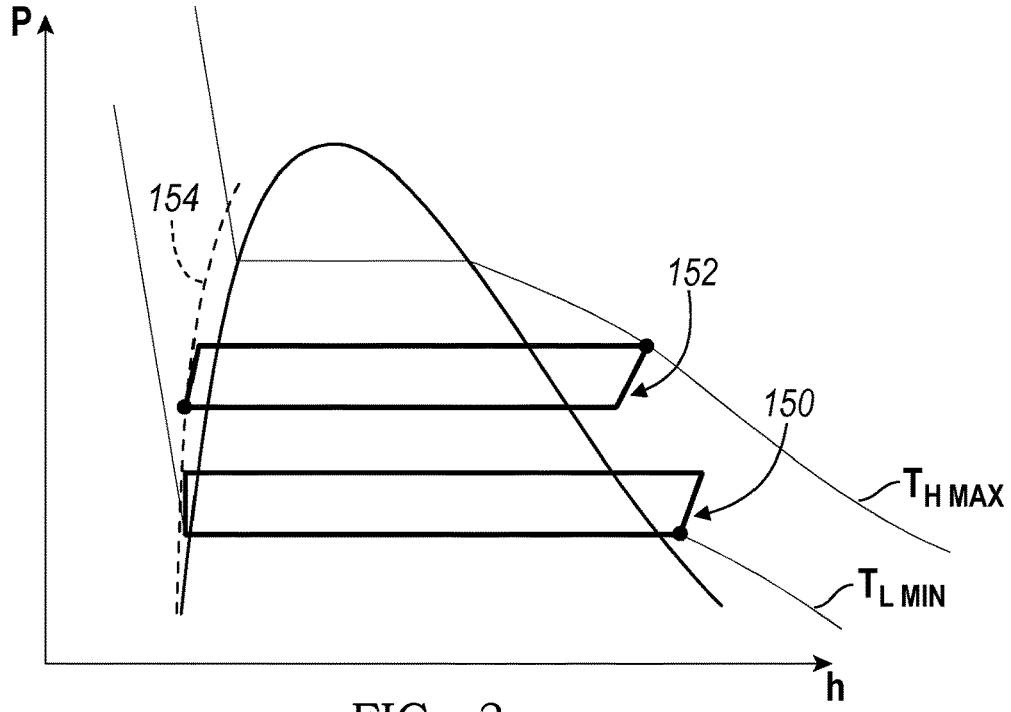
FIG. 3 illustrates a simplified pressure—enthalpy diagram for the Rankine cycle of FIG. 1 at various operating conditions.

The cycle 70 may be operated at various operating conditions, as shown in FIG. 3. FIG. 3 illustrates two operating conditions for the cycle 70. Cycle 150 is shown operating at or near a minimum ambient air operating temperature, $T_{L,min}$. Cycle 152 is shown operating at or near a maximum ambient air operating temperature, $T_{H,max}$. The working fluid is selected based the cycles and operating states of the various points in the cycle, and the constraints imposed by these operating states, for example, maintaining point 130 of each cycle 150, 152 as a compressed liquid as shown by broken line 154. Additionally, the cycle 70 may be controlled to operate within a desired temperature and pressure range by modifying the flow rate of exhaust gas through the heat exchanger 74 using valve 82, thereby controlling the amount of heat transferred to the working fluid and its temperature at point 134. Valve 82 may be a two position valve, or may be controllable to provide variable flow. The heat exchanger 96 may also be controlled by providing additional stages, or limiting stages for working fluid to flow through based on the ambient air temperature, flow rate, and humidity, thereby controlling the amount of cooling and the working fluid temperature at point 130. Additionally, the flow rate of the working fluid may be controlled by the pump 72, such that the working fluid has a longer or shorter residence time in each heat exchanger 96, 74, 76, thereby controlling the amount of heat transferred to or from the working fluid.

Figure 4:
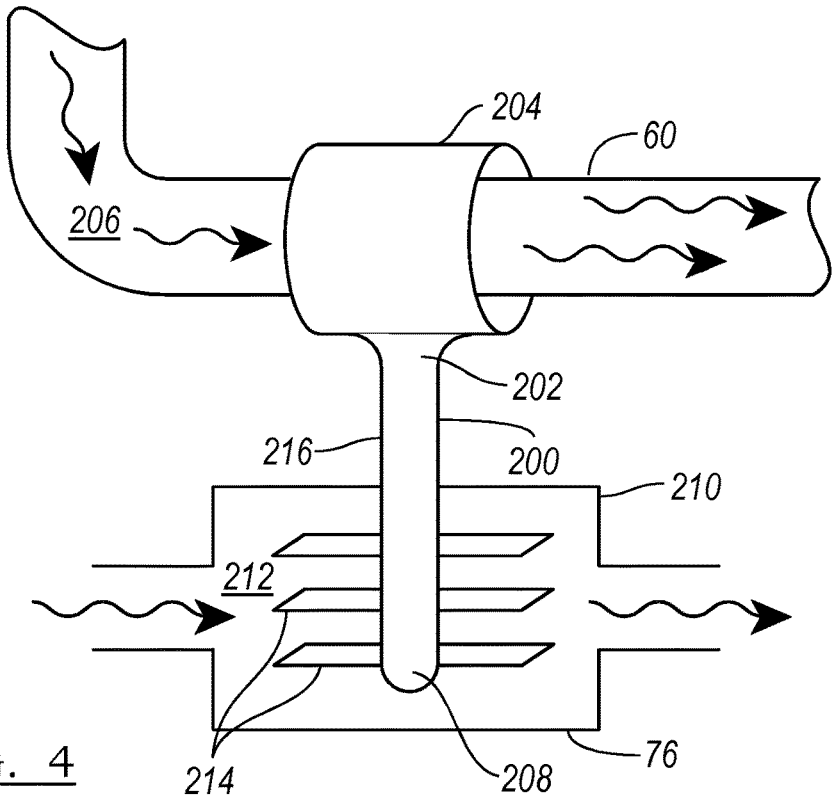
FIG. 4 illustrates a heat pipe according to an embodiment for use with the vehicle of FIG. 1.

FIG. 4 illustrates an example of a heat pipe 200. The heat pipe 200 may be implemented as heat pipe 84 in cycle 70. The heat pipe 200 has an outer shell 202 that contains the phase change material in a sealed environment. The heat pipe 200 has an evaporative region 204 that is in thermal communication with the exhaust system 60 to receive waste heat therefrom. The evaporative region 204 may be thermal contact with the exhaust system 60. The exhaust gases 206 in the exhaust system 60 heat the evaporative region 204 of the heat pipe 200 causing the phase change material within the heat pipe 200 to undergo a phase transition to a vapor.

In one example, as shown, the evaporative region 204 is in physical contact with a surface of the exhaust system 60 such that heat is transferred at least in part via conduction. The evaporative region 204 may be provided as a jacket, plate, or the like in physical contact with an inner or outer surface of the exhaust system 60. The evaporative region may encase a portion of the exhaust system 60, or may act as a liner within the exhaust system 60. In a further example, the evaporative region is included in an integrated exhaust manifold in the exhaust system 60 where the exhaust manifold and cylinder head are incorporated together such that the heat pipe 200 may also provide engine cooling.

In another example, the evaporative region 204 extends into an interior region of the exhaust system 60 such that exhausts gases flow over the evaporative region 204 to transfer heat to the heat pipe 200 at least in part via convection. The evaporative region 204 may be provided with fins or other extended surfaces to increase the surface area of the heat pipe 200 and therefore increase the heat transferred from the exhaust gases to the heat pipe 200. In this example, the evaporative region 204 is designed to limit obstructions for the exhaust gases.

The evaporative region 204 is shown as having a single branch; however, it is contemplated that the evaporative region 204 may have multiple branches, for example, associated with each exhaust runner in the manifold.

The heat pipe also has a condenser region 208 in thermal contact with a heat exchanger of the thermodynamic cycle, such as heat exchanger 76 in the Rankine cycle 70. In one example, as shown, the condenser region 208 extends into an interior region of a chamber 210 defining the heat exchanger 76. The working fluid 212 of the cycle 70, either as a liquid phase, gas phase, or mixed phase flows over the condenser region 208 such that heat is transferred from the surface of the heat pipe 200 at least in part via convection. The condenser region 208 may be provided with fins or other extended surfaces 214 to increase the surface area of the condenser region 208 heat pipe 200 and therefore increase the heat transferred from the phase change material within the condenser region 208 to the working fluid 212. The vapor phase change material in the condenser region 208 heats the working fluid 212 and causes the phase change material within the heat pipe 200 to undergo a phase transition to a liquid. The working fluid 212 may also undergo a phase change or transition depending on the configuration of heat exchanger 76 in the cycle 70 and its operation.

In another example, the condenser region 208 is in physical contact with a surface of the heat exchanger 76 such that heat is transferred at least in part via conduction. The condenser region 208 may be provided as a jacket, plate, or the like in physical contact with an inner or outer surface of the heat exchanger 76. The condenser region may encase a portion of the heat exchanger 76, or may act as a liner within the heat exchanger.

An intermediate region 216 may be provided between the evaporative region 204 and the condenser region 208 and connect the two. The intermediate region 216 may be provided when the exhaust system 60 and the heat exchanger 76 are some distance apart within the vehicle 10. The intermediate region 216 may generally act as a conduit for the phase change material such that there is little or no heat transferred to or from the phase change material within this region 216. In one example, the intermediate region 216 is substantially adiabatic. In some examples, the intermediate region 216 may be covered with an insulating material to provide a generally adiabatic section.

The heat pipe 200 includes a phase change material to transfer thermal energy away from the exhaust system and to the cycle 70. The phase change material may be selected such that it transitions to a vapor at a predetermined exhaust gas temperature thereby providing control over the heat transferred to the cycle 70.

Figure 5:
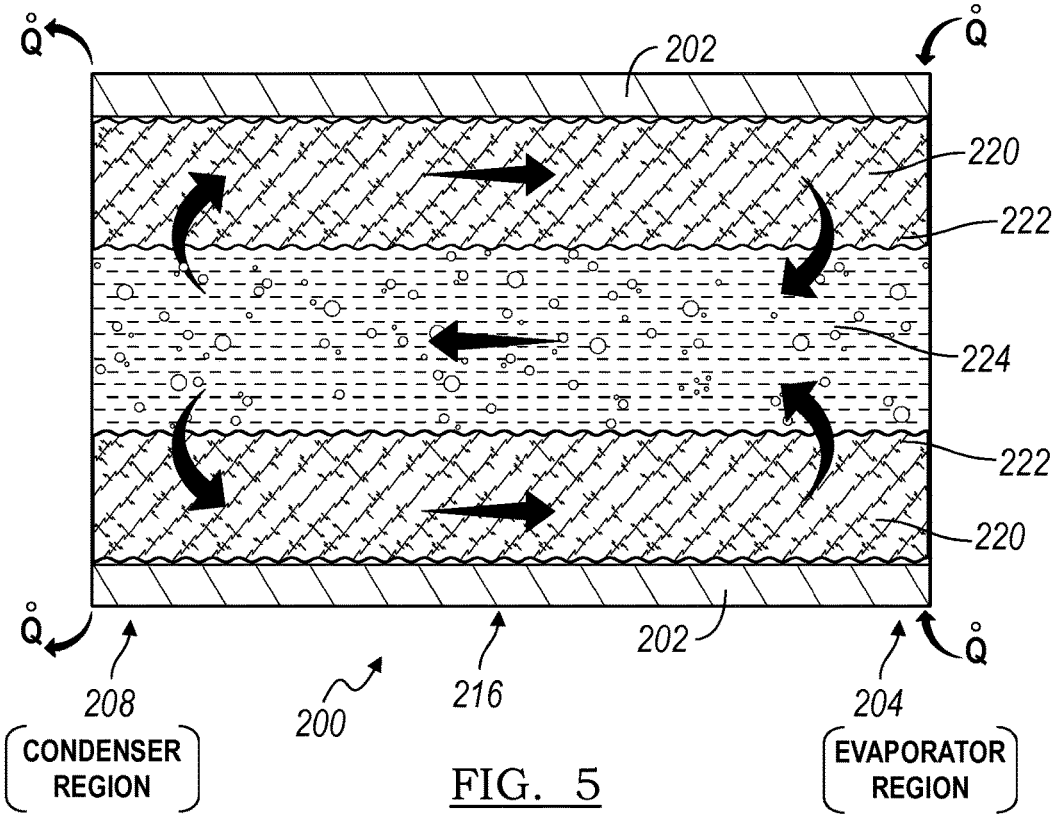
FIG. 5 illustrates a sectional schematic view of the heat pipe of FIG. 4.

FIG. 5 illustrates a sectional schematic view of the heat pipe 200 according to an example. A portion of the heat pipe 200 is an evaporative region 204 receiving heat from exhaust gases and another portion of the heat pipe 200 is a condenser region 208 providing heat to w working fluid of the cycle 70. An intermediate region 216 is provided between the evaporative region 204 and condenser region 208. The heat pipe 200 may be any shape and geometry, and the term pipe does not limit the heat pipe 200 to a hollow cylindrical tube. The heat pipe 200 may have various cross sectional shapes, and may include straight and curved or bent sections, as well as branched or lobed structures. Additionally, heat pipe 200 may include a single heat pipe or may be a bundle of multiple heat pipes or an array of heat pipes.

The heat pipe 200 has an outer shell or wall 202, a liquid space 220, a wicking layer 222, and a vapor space 224. The outer shell 202 encloses the phase change material of the heat pipe 200 and forms the closed passive system. The heat pipe 200 has no moving mechanical components, and operates without mechanical or electrical inputs or power.

The liquid space 220 and the wicking layer 222 may be adjacent to the outer wall 202, and the wicking layer 222 is positioned between the outer wall 202 and the vapor space 224. The wicking layer 222 may be positioned directly adjacent to and in contact with the outer wall 202, or may be spaced apart from the outer wall 202. In one example, the wicking layer 222 is adjacent to the outer wall and contains the liquid space 220. The vapor space 224 may be provided in a central region of the pipe 200.

The outer shell 202 may be formed from a conductive material, such as a metal or the like. In one example, the outer shell 202 is formed from at least one of copper, a copper alloy, aluminum, and an aluminum alloy. Heat is transferred across the outer shell 202 to and from the phase change material within the heat pipe.

The heat pipe 200 is charged with a phase change material (PCM) and sealed. During operation, the phase change material operates between a vapor and a liquid phase. In one example of operation, the latent heat of vaporization causes a pressure differential between the evaporative and condenser regions that act to drive the phase change material in a fluidic cycle.

The wicking layer 222 may provide the liquid space 220. In another example, the wicking layer 222 separates the liquid space 220 and the vapor space 224. The wicking layer 222 may be made of any suitable material for migration and transport for the phase change material. In one example, the wicking layer 222 assists in the mass transfer of the vapor PCM to the vapor space 224 and mass transfer of liquid PCM to the liquid space 220. The wicking layer 222 may provide for a capillary action on the liquid PCM to cause the PCM to cycle in the heat pipe 200. Gravitational forces may also be used to cause fluid motion of the liquid PCM when the condenser region 208 is positioned above the evaporative region 204 and the wicking layer may not be needed; however, the heat pipe 200 may operate regardless of gravitational forces and the orientation of the regions 204, 208.

In one example, wicking layer 222 is a wax coated fiber, or a similar non-absorptive material. In another example, the wicking layer 222 is a porous layer such as a sintered metal powder, a screen, a grooved wick, and the like.

The phase change material (PCM) is selected based on operating temperatures for use with the exhaust system 60 and the cycle 70. The PCM is also selected based on material compatibility with the outer shell and wicking layer. The outer shell may be selected based thermal conductivity and material compatibility with exhaust gases in the exhaust system 60 and/or the working fluid in the cycle 70 based on how the heat pipe 200 is implemented. In one example, the heat pipe has a shell containing copper, and the PCM is water. In another example, the outer shell comprises copper and/or steel and the PCM is a refrigerant, such as R-134a for low temperature and sodium for high temperature. In yet another example, the outer shell comprises aluminum, and the PCM is ammonia. Other combinations of outer shell materials and PCM solutions are also contemplated, the examples provided above are not intended to be limiting.

During operation, the heat pipe 200 operates to absorb and release heat. The phase change material (PCM) is a liquid adjacent to the outer shell in the liquid space or liquid layer 220. The liquid layer 220 may be a liquid film in one example. The liquid PCM is heated in the evaporative region 204 using exhaust gas in the exhaust system 60. The exhaust gases transfer heat via at least one of conduction and convection to the outer shell 202. Heat is transferred across the outer shell 202 via conduction to heat the liquid PCM. The PCM is heated by at least its latent heat of vaporization such that it undergoes a phase change from a liquid to a vapor.

The vapor PCM then flows across and through the wicking layer 222 as indicated by arrows, and into the vapor space 224. The vapor PCM flows within the vapor space 224 from the evaporative region 204 to the condenser region 208, from the warm side to the cold side, or from right to left in FIG. 5.

Within the condenser region 208, the vapor PCM is cooled via heat transfer to the working fluid in the cycle 70. Heat is transferred from the PCM and across the outer shell 202 via conduction to cool the PCM. Heat is transferred from the outer shell via at least one of conduction and convection to the working fluid in the cycle 70. The liquid PCM flows across and through the wicking layer 222 as indicated by arrows, and into the liquid space 220. The PCM is cooled by at least its latent heat of vaporization such that it undergoes a phase change from a vapor to a liquid. The liquid PCM flows within the liquid space 220 from the condenser region 208 to the evaporative region 204, from the cold side to the warm side, or from left to right in FIG. 5.

Various examples of the present disclosure have associated, non-limiting advantages. For example, a thermodynamic cycle in a vehicle may be used to recover waste heat and energy and increase vehicle efficiency. The thermodynamic cycle may be a Rankine cycle. A heat pipe is provided to receiver waste heat from the engine exhaust gases and heat the working fluid in the thermodynamic cycle. The heat pipe provides a passive device for heat transfer between the exhaust gases and the working fluid. The heat pipe is a closed, sealed system that contains a phase change material that operates between a liquid phase and a vapor phase. The high efficiency and thermal conductivity of the heat pipe provides a reliable and effective way of heating the working fluid in the cycle and recovering waste heat from the exhaust gases. The heat pipe may also be selected for selective cooling of the exhaust gases based on emissions system requirements. For example, when the heat pipe is provided in an exhaust system upstream of an emissions system, it may be desirable to not operate the heat pipe when the exhaust gases are below a predetermined temperature. When the exhaust gases are below a predetermined temperature, any further cooling of the exhaust gases, for example, with a conventional air or water cooled heat exchanger without a bypass system, may delay a catalytic converter light off at a cold start condition, and running the engine at a fuel rich condition may reduce fuel economy for the vehicle. A heat pipe containing a working fluid selected based on the predetermined temperature of the exhaust gases may only operate above this predetermined temperature, as below the temperature, working fluid will not undergo a phase change, and therefore the heat will not operate. In one example, the working fluid in the heat pipe comprises sodium at a pressure to provide a phase change above 700 degrees Celsius, which may not affect light off of the catalytic converter. As the heat pipe only operates above the predetermined exhaust gas temperature, there is no need for a bypass system, and the heat pipe selectively provides heat to the Rankine cycle without use of an additional control system.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle comprising:

an engine having an exhaust system;

a heat pipe containing a phase change material and having a condenser region and an evaporative region, the evaporative region in thermal contact with the exhaust system; and an expander, a first heat exchanger, a pump, and a second heat exchanger each in sequential fluid communication in a thermodynamic cycle containing a working fluid, the second heat exchanger in thermal contact with the condenser region.

2. The vehicle of claim 1 wherein the heat pipe is a closed, passive system.

3. The vehicle of claim 1 wherein the heat pipe has a vapor space and a liquid space separated by a wicking layer.

4. The vehicle of claim 3 wherein the heat pipe has an outer wall, the liquid space is adjacent to the outer wall, and the wicking layer is positioned between the outer wall and the vapor space.

5. The vehicle of claim 1 wherein the heat pipe has an intermediate region positioned between and connecting the evaporative region and the condenser region, the intermediate region being adiabatic.

6. The vehicle of claim 1 wherein the evaporative region of the heat pipe is configured to passively transfer heat from exhaust gases in the exhaust system to the phase change material.

7. The vehicle of claim 6 wherein the evaporative region of the heat pipe is positioned within an interior region of the exhaust system such that exhaust gases in the exhaust system flow over the evaporative region.

8. The vehicle of claim 7 wherein the condenser region of the heat pipe is positioned in the second heat exchanger such that the working fluid of the thermodynamic cycle flows over an outer surface of the condenser region.

9. The vehicle of claim 6 wherein the evaporative region of the heat pipe is positioned along an outer surface of the exhaust system to receive heat from exhaust gases in the exhaust system.

10. The vehicle of claim 1 wherein the condenser region of the heat pipe is configured to passively transfer heat from the phase change material to the working fluid.

11. The vehicle of claim 10 wherein the condenser region of the heat pipe is positioned in the second heat exchanger such that the working fluid of the thermodynamic cycle flows over an outer surface of the condenser region.

12. The vehicle of claim 11, wherein the condenser region of the heat pipe has fins extending outwardly therefrom.

13. The vehicle of claim 1 wherein the second heat exchanger is one of a preheater, evaporator, and a superheater.

14. The vehicle of claim 13 wherein the first heat exchanger is a condenser.

15. The vehicle of claim 1 further comprising an electrical generator drivably connected to the expander and in electrical communication with a traction battery.

16. A vehicle comprising:

an engine having an exhaust system;

a heat pipe containing a phase change material and having a condenser region and an evaporative region, the evaporative region in thermal contact with the exhaust system, the heat pipe defining a vapor space and a liquid space separated by a wicking layer; and an expander, a condenser, a pump, a first heater, and a second heater, each in sequential fluid communication in a thermodynamic cycle containing a working fluid, the first heater in thermal contact with exhaust gases in the exhaust system, the second heater in thermal contact with the condenser region of the heat pipe.

17. The vehicle of claim 16 wherein the condenser region on the heat pipe is positioned within an interior region of the second heater of the cycle such that working fluid flows over an outer surface of the condenser region.

18. The vehicle of claim 16 wherein the heat pipe has an outer wall, the liquid space and the wicking layer being adjacent to the outer wall, and the wicking layer positioned between the outer wall and the vapor space.

* * * * *